US011702785B2

(12) United States Patent
Rupnow

(10) Patent No.: US 11,702,785 B2
(45) **Date of Patent: *Jul. 18, 2023**

(54) OZONE INJECTION SYSTEMS

(71) Applicant: OMNI SOLUTIONS LLC, Baraboo, WI (US)

(72) Inventor: Andrew Rupnow, Madison, WI (US)

(73) Assignee: OMNI SOLUTIONS LLC, Baraboo, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/837,884

(22) Filed: Jun. 10, 2022

(65) Prior Publication Data

US 2022/0298697 A1 Sep. 22, 2022

Related U.S. Application Data

(60) Continuation of application No. 17/013,124, filed on Sep. 4, 2020, now Pat. No. 11,384,468, which is a division of application No. 16/251,070, filed on Jan. 17, 2019, now Pat. No. 10,801,151, which is a division of application No. 14/445,720, filed on Jul. 29, 2014, now Pat. No. 10,208,420.

(60) Provisional application No. 61/860,506, filed on Jul. 31, 2013.

(51) Int. Cl.

| | |
|---|---|
| ***D06F 35/00*** | (2006.01) |
| *D06F 39/08* | (2006.01) |
| *D06F 34/14* | (2020.01) |

(52) U.S. Cl.

CPC ..... *D06F 35/001* (2013.01); *D06F 34/14* (2020.02); *D06F 39/088* (2013.01); *Y10T 137/86035* (2015.04)

(58) Field of Classification Search

CPC ..... D06F 35/001

See application file for complete search history.

(56) References Cited

U.S. PATENT DOCUMENTS

| | | | |
|---|---|---|---|
| 3,707,856 | A | 1/1973 | Niewyk |
| 3,961,231 | A | 6/1976 | Gillespie |
| 4,003,832 | A | 1/1977 | Henderson |
| 4,230,571 | A | 10/1980 | Dadd |
| 5,097,556 | A | 3/1992 | Engel |
| 5,181,399 | A | 1/1993 | Engel |
| 5,241,720 | A | 9/1993 | Engel |
| 5,765,403 | A | 6/1998 | Lincoln |
| 5,806,120 | A | 9/1998 | McEachern |
| 5,960,501 | A | 10/1999 | Burdick |
| 6,085,556 | A | 7/2000 | Moon |
| 6,115,862 | A | 9/2000 | Cooper |

(Continued)

FOREIGN PATENT DOCUMENTS

| | | |
|---|---|---|
| CA | 2310864 A1 | 12/2001 |
| CN | 202482160 U | 10/2012 |

(Continued)

*Primary Examiner* — Jason Y Ko

(74) *Attorney, Agent, or Firm* — Nixon Peabody LLP

(57) ABSTRACT

An ozone laundry system that injects ozone into the chemical injection system in order to allow the system to inject ozone as other cleaning chemicals are injected into the washer. This allows ozone to be injected through the wash cycle rather than just during the initial fill phase and additional avoids the expense and maintenance of adding ozone recirculation plumping to an ozone laundry system. Accordingly, ozone levels may be maintained at superior levels throughout the wash cycle.

11 Claims, 2 Drawing Sheets

(56) References Cited

U.S. PATENT DOCUMENTS

| | | | |
|---|---|---|---|
| 6,685,825 | B1 | 2/2004 | Chang |
| 7,493,782 | B2 | 2/2009 | Daniels |
| 2004/0221873 | A1 | 11/2004 | Rusciolelli |
| 2008/0092601 | A1 | 4/2008 | Konides |
| 2008/0302139 | A1 | 12/2008 | Zorn |
| 2010/0329941 | A1 | 12/2010 | Moore |
| 2011/0147283 | A1 | 6/2011 | Taylor |
| 2012/0017379 | A1 | 1/2012 | Moore |
| 2012/0094887 | A1 | 4/2012 | Tanaka |
| 2012/0231549 | A1 | 9/2012 | Miller |
| 2014/0283564 | A1 | 9/2014 | Cagliani |
| 2016/0168776 | A1 | 6/2016 | Xu |

FOREIGN PATENT DOCUMENTS

| | | | |
|---|---|---|---|
| KR | 100901794 | B1 | 6/2009 |
| KR | 2013-0074430 | A | 7/2013 |
| WO | WO 03/016608 | A1 | 2/2003 |
| WO | WO 2007/143785 | A1 | 12/2007 |
| WO | WO 2010/028467 | A1 | 3/2010 |
| WO | WO 2014/146165 | A1 | 9/2014 |
| WO | WO 2016/054517 | A1 | 4/2016 |
| WO | WO 2016/094658 | A1 | 6/2016 |

OZONE INJECTION SYSTEMS

CROSS REFERENCE TO RELATED APPLICATIONS

This application claims priority to U.S. Provisional Application No. 61/860,506 filed Jul. 31, 2013, the contents of which are incorporated herein by reference.

FIELD

The present invention is directed to ozone injection systems for laundry machines.

BACKGROUND

Ozone laundry machines are an alternative to regular washing machines that inject dissolved ozone gas ($O_3$) in the washing liquid of a washing machine. The dissolved ozone oxidizes the dirt and other soil on the laundry and cleans them quite effectively. Ozone laundry systems generally require the water to be at a much lower temperature than conventional washing machines and thus require far greater electricity. Accordingly, ozone laundry machines have become popular recently as an energy efficient alternative to washing machines.

SUMMARY

Ozone laundry machines utilize several different methods for introducing ozone into the washing liquid. Most ozone laundry machines inject ozone into the washing drum through the water fill lines. The water fill lines only fill up the washing drum during the initiation of the cycle, when the water is first released into the drum. Accordingly, the fill lines do not dispense water for the rest of the cycle, as it would dilute the drum's concentration of chemicals. Accordingly, ozone laundry machines that introduce ozone through the fill lines are limited to a single injection period, during the fill cycle. Other ozone washing machines either recirculate wash water and continually add ozone to the wash water, or directly inject gas into the washer drum. However, each of these methods has several disadvantages that are explained below.

Indirect Injection

Systems that inject ozone through the fill lines, by for example, connecting a manifold to the water fill lines are called indirect or passive injection systems. Ozone system that inject ozone through these fill lines pose several problems. Particularly, ozone systems with oxygen concentrators have a ramp up period, typically 20-60 seconds, to begin operating at an effective capacity. Additionally, washer fill times are from 1-5 minutes, which is a minimal amount of time to inject enough ozone to effectively oxidize soils, bacteria, and viruses. According to the International Ozone Association (IOA), a starting (without replenishing continuously) dissolved zone level 1 ppm of ozone in 15 gallons of water at 75 degrees that is vigorously agitated will revert back to oxygen within 2-4 minutes.

Therefore, there are many disadvantages of indirection ozone injection systems that inject ozone through the fill lines. These include: (1) low dissolved ozone levels for the majority of the wash cycle following a short time after filling, (2) low gas phase ozone levels, (3) fast degeneration of ozone due to high pH, (4), high in maintenance, and (5) adding the same amount of ozone for each wash cycle, and lack of ability to customize ozone levels for particular wash loads.

Charged Ozone

Charged ozone systems are commonly used for drinking water applications and have recently been adapted for laundry. Charged ozone systems have a tank or reservoir that keeps dissolved ozone ($O_3$) levels around 2 ppm. To do this properly, a $DO_3$ controller is required. As indirect injection systems, charged systems inject during fill only, but achieve a higher ppm of $DO_3$ than indirect injection systems.

For both indirect and charged ozone systems, the introduction of alkali detergents will cause the ozone to off gas immediately. Ozone gas does not dissolve or stay dissolved in water that has a pH of 8.5 or greater. Alkali detergents used in laundry machines increase the pH level of the wash water to approximately 11 pH. Therefore, although the initial ppm of ozone levels injected into the wash drum may be sufficiently high, once alkali detergents are added the ozone levels will fall dramatically. Therefore, these methods that only introduce ozone during the fill cycle have low ozone levels for the majority of the ozone cycle, especially once alkali detergent is added.

There are other disadvantages of charged ozone systems that include: (1) large footprint, (2) they can damage the washer, (3) they are high in maintenance, and (4) they add the same amount of ozone for each wash cycle, and their ozone levels cannot be customized for particular wash loads.

Recirculation

Another type of ozone system is recirculation systems. Recirculation systems continually recirculate the wash water as it is washing laundry and adding ozone through values at certain points in the recirculation stream. Accordingly, recirculation systems may continually maintain ozone levels in the wash water through the wash cycle. Therefore, they do not have many of the disadvantages of the two systems above that only inject ozone during the wash cycle. However, recirculation system are very complex to implement, expensive, and requires a licensed plumber to install. Lint ends up clogging the pumps, which require major maintenance. Furthermore, conventional recirculation systems add the same amount of ozone for each wash cycle, and one cannot customize ozone levels for particular wash loads.

Direct Injection

Finally, diffusion systems inject ozone gas (not pre dissolved in water) directly into the sump of the washer continuously throughout each step of the wash cycle. Some diffusion systems use diffusion stones that produce micron sized gas bubbles. However, the diffusion stones often corrode over time and require maintenance. Furthermore, this system generally has lower dissolved ozone gas levels, has high off-gassing potential (ambient ozone gas can reach toxic levels) and generally add the same amount of ozone for each wash cycle, and one cannot customize ozone levels for particular wash loads.

Ozone Injected in Chemical Lines

Accordingly, a need exists for an ozone injection system that has low maintenance, low installation costs, may vary the amount of ozone injected per cycle, and keeps the ozone levels at adequate levels through the wash cycle. Accordingly, systems and methods have been developed to allow ozone gas to be injected at various stages and entry points along the chemical introduction systems and lines of the ozone laundry system. The chemical lines inject the detergent and other chemicals used for laundry. The chemical lines are separate from the fill lines and generally consist of several chemical drums with pumps that are fed into a manifold to be mixed with r water inlet that is separate from the fill water inlet (which have different flow rates). The chemicals and water are then mixed to be injected into the washer drum. These injections take place during various phases of the wash cycle, accordingly, they serve as useful times to inject additional ozone through the cycle.

Accordingly, ozone may be introduced into the chemical lines at various stages of the chemical introduction system and by various methods. In some embodiments, the ozone may be introduced into the chemical fill lines after the water and chemicals have mixed and exited the flush manifold. In those embodiments, the ozone gas may be injected with an ozone generator in conjunction with a venturi by-pass manifold or other dissolving system, or a UV ozone/hydroxyl generator. This ozone/hydroxyl introduction may then take place later along the chemical introduction system to minimize off gassing through the process that might take place if introduced prior to mixing in the flush manifold or elsewhere in the system.

In other embodiments, the ozone may be injected in the water supply line upstream from the flush manifold that mixes the chemicals into the water supply. This will potentially allow more ozone to dissolve in the water prior to adding alkaline or other chemicals that make dissolving the ozone more difficult. In some embodiments, the UV introduction may be more beneficial downstream from the flush manifold and the venturi introduction may be more beneficial upstream where it needs to be dissolved.

This process may be performed at varying water and air temperatures. In some embodiments, cooler temperatures may be implemented to slow and stabilize ozone hydroxyl reaction time. By injecting ozone into the washer with the chemical dispensing system, amount of ozone introduced into the system may be varied depending on the soil levels of the laundry. The ability to control the amount of ozone will be able to minimize the amount of off gassing while making sure an adequate amount is introduced into the washer drum in order to clean the laundry.

Organic load has a major impact on ozone's performance. Heavy organic load causes ozone to oxidize rapidly while light organic loads cause ozone to oxidize at a slower pace. Integrating the ozone adding site with the chemical dispensing line (which is continually adding chemicals during the ozone wash process and thus allows the ozone to be added continually through the laundry cycle) provides the ability to control the ozone for different organic loads. This is important to combat heavy organic loads (add more ozone) and prevent ozone from off-gases into working environments on light organic loads (less ozone added). The controller can be programmed to add ozone either by timing a water solenoid valve to open and close, allowing more water to be treated with ozone and enter into the wash machine. In some embodiments, the controller can dose ozone in ounces (similar to chemicals), and therefore a specific ozone dosage amount can be applied for the individual wash step for each wash formula.

Each system set up may be slightly different for the end user, variables include: (1) linen/fabric type, (2) size of washer, (3) water quality, (4) soil contamination, and (5) washer manufacturer. This type of system also requires less maintenance than prior systems, will not damage machinery, and is cost effective.

Ozone may be injected into washer machine every time the washer fills with water through water inlets on washer machine using an ozone system with a venturi manifold or water passing over UV light. Dissolved ozone concentrations may be used between 0.1-5 PPM, or other suitable concentrations. Ozone levels may then be controlled and maintained in the wash machine using the chemical pump controller and flush manifold. Water may be controlled by a solenoid valve from the chemical controller and pump. Ozone is injected into the water via venturi or water passing over UV light. Ozone dosage amounts may be programmed based on soil and contaminant load, adding more or less ozone dissolved water with the programmer and controller. Ozone levels may be maintained between 0.1-5 ppm, or other suitable ranges with little to no off gassing of ozone. In some embodiments, ozone levels may be maintained at 1 ppm. System costs are dramatically less expensive with little to no maintenance costs.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

In the drawings, the same reference numbers and any acronyms identify elements or acts with the same or similar structure or functionality for ease of understanding and convenience.

DETAILED DESCRIPTION

Figure 1:
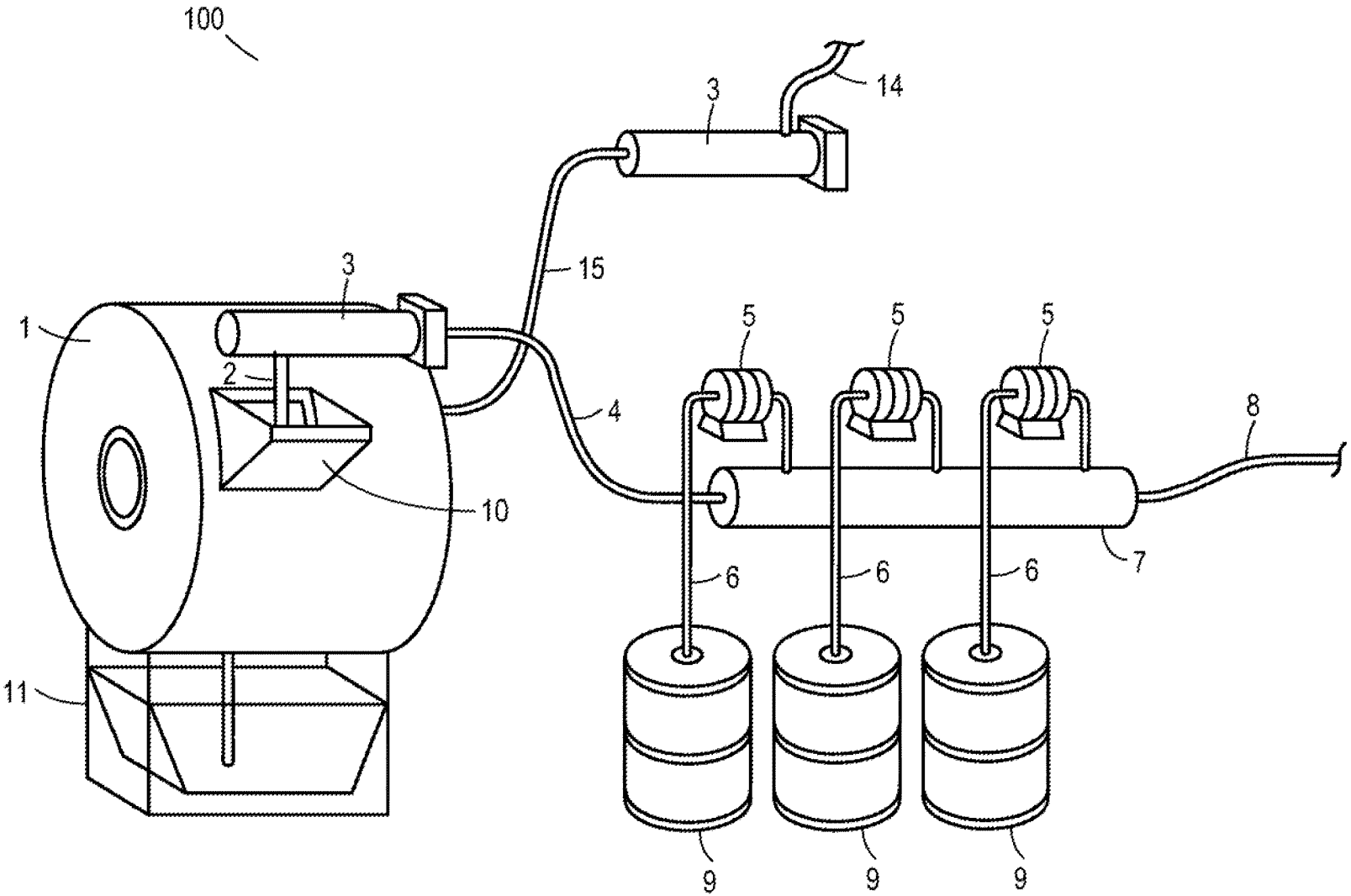
FIG. 1 is a diagram of an embodiment of an ozone laundry machine according to the present disclosure.

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other obvious features not described in detail herein. Additionally, some well-known structures or functions may not be shown or described in detail below, so as to avoid unnecessarily obscuring the relevant description.

The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

Particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly while operations may be depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Overview of System

FIG. 1 illustrates an example of an ozone laundry system 100 that introduces ozone in the chemical supply lines using a UV ozone generator. Included is a wash drum 1 for depositing soiled laundry and wash liquid, a washer base and sump 11. The ozone laundry system 100 may include at least two supply lines: (1) a fill line 15 that introduces water to fill the wash drum 1 during the initiation phase and (2) a chemical supply line 4 that introduces detergent, bleach and other chemicals into the wash drum 1 during the laundry cycles.

Ozone Introduction into Fill Lines

When a laundry cycle is determined, a control system on the washer will be selected for a specific cycle. The same cycle may then be input into a control system for the chemical supply line. Then, once the soiled laundry has been deposited in the wash drum 1, and the cycle is initiated, the water fill line 15 will begin filling the wash drum 1. To do this, a valve on the fill water supply line 14 or connected to it will open and allow the wash drum 1 to fill with water. In some embodiments, there may be different fill levels depending on the amount of laundry. Generally, these fill lines 15 only contain an on/off valve that has quite a high rate of flow that fills the wash drum 1 quickly. This is because that is all that is required is an on/off valve for filling, and it is more expensive to implement a control system to more closely regulate the fill lines—which is not necessary. In other embodiments, there may be more specialized or closely regulated fill lines.

Once the valve is open and fill water begins to start following through the fill water inlet 15 line, the water will flow through an ozone generator 3. In some embodiments, once the water begins to flow, the ozone generator system 3 may be switched on by a flow sensor, or may always be one during operation and will cause dissolved ozone gas to be generated in the fill lines.

Ozone Generation Systems

In order to dissolve or generate dissolve ozone into feed water, many different systems may be utilized: (1) a UV ozone generator or (2) a dielectric (corona discharge) with a venture by-pass manifold, (3) diffusion systems that directly inject gas into the feed lines, (4) mixing valve or pump (5) an electrolytic generator system and (6) any other suitable systems. For example, ozone can be generated from a feed gas of compressed ambient air, an oxygen concentrator or pure oxygen. As the feed gas is exposed to and electrical high voltage or plasma field the $O_2$ molecule divides into $O_1$ and reforms as $O_3$ or ozone. Ozone can vary in concentrations based on the feed gas. The higher the concentration of oxygen the higher concentrations of ozone are produced.

Ozone can also be produced by applying UV light to feed water. UV light with wave lengths between 185 and 254 nanometer wave lengths can create ozone from a feed gas and/or water. Oxygen within the water will convert to $H_2O_3$, $O_3$ and other oxidative compounds. FIG. 1 illustrates a UV ozone generator 3 that is downstream of the fill water supply line 14. Accordingly, during the fill process the flow in the lines will cause ozone to be generated based on UV light being radiated in the feed water that is flowing through the ozone generation system 3. Accordingly, using the fill system, ozone may be initially introduced into wash drum water during filling.

Ozone Introduction into Chemical Lines

Ozone may also be introduced through the chemical lines in the chemical injection system during the wash cycle. This may be in addition to or separate from the ozone system that introduces ozone into the fill system or lines. After the fill phase is complete or during the fill phase, chemicals are deposited through the chemical injection system (which is separate from the fill system) into the wash drum 1 on quantities and timings based on the cycle selected and the current stage of the cycle. For example, detergent, bleach, and softener and other chemicals may be deposited into the wash drum 1 and various stages of the wash cycle.

The chemical injection system injects chemicals that are stored in various chemical contains 9 associated with the system. For example, in some embodiments, there may be a container 9 for detergent, one for bleach, one for fabric softeners and others. Once a specific chemical is need, the chemical injection system control may trigger the initiation of the correct chemical pump 5 to begin pumping the chemical into a flush manifold 7 where it may be mixed with water from the water inlet 8. The control will send a signal to the chemical pump 5 to pump a certain amount of chemical from the chemical container 9 and also to open a valve (e.g. solenoid) on the water inlet 8 for a certain amount of time. The control system then controls the timing of the injection system, and begins to start pumping chemicals, and then after a delay opens the valve to the water inlet 8. This will allow water and chemical to enter the flush manifold 7 at the same time to ensure proper mixing. In some embodiments, the chemical pump may also be told to leave the valve to the water inlet 8 open for longer to allow more water to be flushed through the manifold 7 and into the drum 1, without adding further chemicals from the container 9. In this way, the control for the chemical injection system may finely control the amount of chemical and water mixture that is pumped into the drum 1 from the container 9 and the water inlet 8. Accordingly, with different timings, various amounts of water from the inlet 8 and chemicals from the container 9 may be added, in varying flow rates, dilutions, and timings. In some embodiments, a dummy chemical pump 5 may be included that is not connected to a chemical container 9, but is connected to the water inlet 8. Accordingly, the dummy chemical pump 5 may then send a signal to a valve on the water inlet 8 that allows water to flow through the inlet and flush manifold 7 to the drum 1 without adding additional chemicals.

After the chemicals and water have mixed in the flush manifold 7, the chemical and water mixture exits the manifold 7 and enters the flush manifold output 4. Then, the chemicals travel through the ozone generator 3 to the chemical supply line 2, where they are injected into the chemical chute or hopper 10. Once the water/chemical mixture enters the chemical chute 10, in then enters the wash drum 1 to mix with the wash water and disinfect and clean the soiled laundry. The chemical injection system may include a control that may have more precise control over the flow rates of injection into the drum then the fill water injection system. This is because, the fill water inlet 15 and associated lines are meant to quickly fill the drum 1 with water at the beginning of the cycle. However the chemical injection system and associated lines are meant to more precisely enter smaller amounts of chemical and water mixture into the drum 1 and therefore provide a more precise way of entering chemicals. Furthermore, the flow rates on the chemical supply lines are generally less than the flow rates on the water fill lines.

In order to inject ozone into the chemical lines along this chemical injection system, an ozone generator 3 may be placed at various points along the chemical fill lines. In some embodiments, the ozone generator 3 may be downstream from the flush manifold 7 in order to introduce ozone into the chemical fill line at the last time possible prior to entering the chemical chute 10 and wash drum 1, to minimize off gassing and ozone reactivity prior to entering the drum 1. In other embodiments, the ozone generator 3 may be upstream from the flush manifold 7 but downstream from the water inlet 8. In still other embodiments, the ozone generator may be upstream from a chemical pump 5 that is linked to an ozone generator 3 rather than a chemical container 9.

In some embodiments, various types of ozone generators may be utilized for certain configurations for injecting ozone into the chemical fill lines. For example, FIG. 1 illustrates a UV based ozone generator downstream of the flush manifold. In this embodiment, the UV generator may be switched on whenever there is flow through the ozone generator 3, for instance, by using a flow switch upstream or downstream from the ozone generator 3. In some embodiments, such a UV ozone generator 3 may remain in operation, and when the flow lines in the chemical injection system were turned on, the system would inject ozone into the water stream as water passed through.

Figure 2:
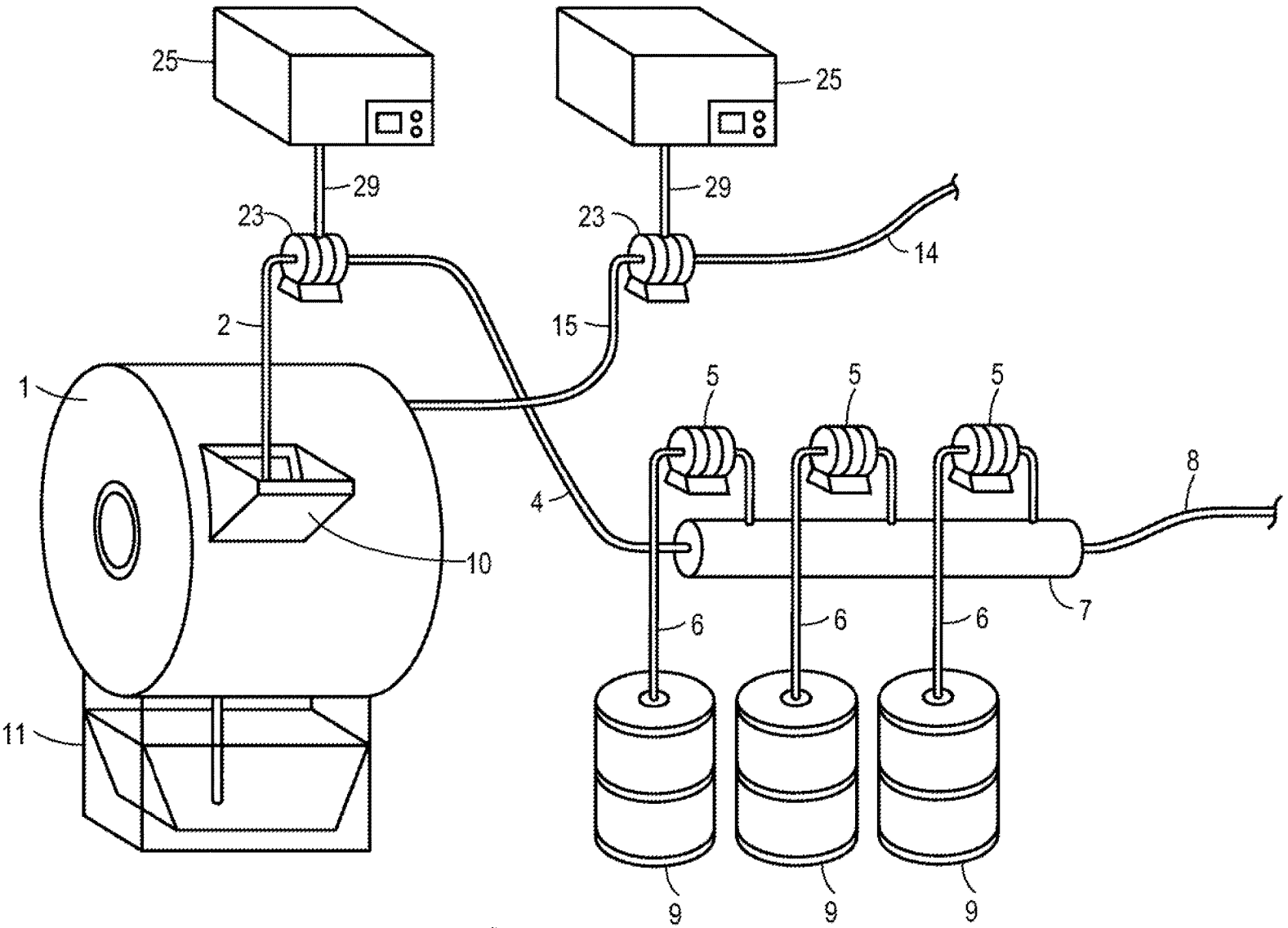
FIG. 2 is a diagram of another embodiment of an ozone laundry machine according to the present disclosure.

FIG. 2 illustrates another embodiment of the system that includes ozone generators 25 that are ozone gas generators 25 (e.g., dielectric corona discharge). In this embodiment, ozone gas is generated and must be mixed in the water/chemical lines' liquid in order to dissolved the ozone gas and be useful once injected into the wash drum 1. In embodiments where ozone gas generators 25 are used, various methods may be utilized to mix the ozone gas into the water or water chemical mixture so that the ozone gas dissolves into the liquid.

For example, in some embodiments, a venturi system may be utilized. In those embodiments, the ozone generators 25 may be operational during a wash cycle, creating ozone gas that remains contained in an ozone gas supply line 29 until utilized. In those embodiments, the gas be back stopped at the venturi until water or water/chemical mixture begins to flow through the flush manifold output and chemical supply line through the venturi 23. Accordingly, the ozone gas will not be dissolved or mixed unless water is flowing through the lines of the chemical injection system into a wash drum 1. This system has a distinct advantage in that the ozone generator itself is not required to be turned on and off. Rather the flow through the venturi 23 will cause gas to be automatically drawn out of the ozone gas supply line 29 and dissolve into the liquid/chemical mixture in the chemical supply line 2. As mentioned previously, the venturi may also be situated upstream of the flush manifold 4 and along the water inlet 8. However, in this embodiment, there may be greater off gassing as the water would have to travel further prior to entering the wash drum 1 with ozone dissolved.

Other methods of introducing the ozone gas into the liquid of the fill lines and/or the chemical injection system may be utilized. For example, mixing pumps may be utilized that are switched on and off as the chemical supply line is turned on for each stage of the wash cycle. However, these embodiments may require extra valves and equipment in comparison to the venturi embodiment. In some embodiments, a venturi system may be utilized with a gas valve that opens and closes the ozone gas supply line 29. In other embodiments, direct diffusion of ozone into the various portions of the fill lines and chemical supply lines may be utilized. This method may also require a valve to close and open the gas supply lines 29, and may have less of ozone dissolved into the liquid and accordingly more off gassing once the liquid enters the washer drum 1.

Adding ozone to the washer drum 1 through the chemical injection system has many advantages over systems that only either: add the ozone to the fill lines, recirculate ozone using pumps, or directly injecting it into the drum 1. First, with respect to systems that only injecting ozone into the fill lines, as described above, those systems greatly limit the amount and concentration of the ozone for the majority of the wash cycle as the ozone is generally only added in the beginning of the wash cycle. Furthermore, with the recirculation systems, the ozone may be maintained at higher levels, however, the system is quite expensive, and is prone to high maintenance requirements. Particularly, as additional plumbing is required, the pumps and recirculation system may clog with lint, and require additional electricity to run which ultimately may eliminate the efficiency gains of using an ozone laundry system.

Accordingly, the ozone system presently disclosed has the advantage of adding dissolved ozone to the chemical lines that already add liquid and chemicals into the wash drum 1, and therefore, the addition of ozone generally does not add additional liquid. This is advantageous, as additional liquid would generally dilute the concentration of the cleaning chemicals in the ozone drum. Furthermore, the control and pump system for the chemical lines already exists and would be installed with a laundry unit, and therefore adding an ozone injection point along the chemical injection system would be not add considerably to the cost or labor of installation, except for the addition of the ozone units. Therefore, this will allow ozone to be injected in the laundry system through the ozone cycle.

For example, varying amounts and concentrations of ozone may be added to the washer drum 1 by way of the control system manipulating the timing and control of the chemical injection system. As discussed above, the chemical pumps may be controlled by the chemical control system to dilute the chemicals with more or less water from the water inlet 8. Generally, the control system sends a signal to the chemical pump 5 which controls the amount of chemicals pumped from the containers 9. In turn, the chemical pump 5 then controls or relays the control signal to the water inlet 8 valve to determine the amount of water also mixed with the chemicals in the manifold 7. In other embodiments, the control system may be configured to directly control the water inlet 8.

For many embodiments discussed herein, ozone may be effectively added at any time the ozone generator is operating and water is flowing through the chemical lines of the chemical injection system. Accordingly, if the control system sends a signal to turn on a chemical pump 5, but also instructions to add more water from the water inlet 8 than usual, more ozone will be introduced into the wash drum 1 than for a typical chemical injection. As another example, the dummy chemical pump 5 may also be switched on to initiate water flowing from the water inlet 8 in order to add additional ozone into the wash drum 1 without adding more chemicals. Therefore, because the chemical injection system is utilized, the precise amounts of ozone enriched water that is added to the wash drum 1 may be more finely regulated. For example, it may be desired to keep the ozone levels at 0.5 ppm, 1 ppm, 2 ppm, or other concentrations. It has been discovered that using the systems disclosed herein, for example, the ozone concentration in the wash drum may be maintained at 1 ppm for various types of wash cycles throughout the cycle.

For instance, if the flow rate through chemical injection system is known along with the amount of ozone injected by the ozone introduction system into the chemical lines per ounce of water that flows through, the amount of ozone in ounces or other units being deposited into the wash drum 1 may be calculated. Accordingly, the amount of ozone needed to be added to appropriately raise the ozone levels in the wash system to a desired ozone level may be calculated. In some embodiments, a feedback system may be implemented with an ozone sensor (or several sensors) in the wash drum 1 that send an indication of the ozone levels in the wash drum 1 to the controller to allow the controller to determine the amount of ozone needed to be added to the wash drum 1 to bring the ozone levels up to the appropriate concentration. Then, the controller may then determine the precise control logic required to command the chemical/dummy pumps 5 and/or water inlet 8 to deliver the needed amount of ozone to the wash drum 1. This disclosed system provides a thorough cleaning of wash loads by maintaining ozone levels through the wash cycle.

Although the ozone system has been described with respect to these two embodiments, various other embodiments may be implemented that inject ozone into various points along the chemical line and take advantage of the already sophisticated water/chemical injection system in place.

The invention claimed is:

1. An ozone laundry system comprising:

a wash drum;

a first water supply line configured to deliver water to the wash drum;

a flush manifold coupled to one or more chemical containers, the flush manifold configured to receive chemicals from the one or more chemical containers;

an ozone generator in fluid communication with an inlet of the flush manifold and a second water supply line, the ozone generator being configured to:

introduce ozone directly into water received from the second water supply line, provide the mixture of water and ozone to the inlet of the flush manifold, the flush manifold thereby forming a mixture of water, chemicals, and ozone therein; and a chemical supply line coupled to an outlet of the flush manifold configured to deliver the mixture of water, chemicals, and ozone to the wash drum.

2. The ozone laundry system of claim 1, wherein the ozone generator is a UV ozone generator.

3. The ozone laundry system of claim 1, wherein the ozone generator is a gas ozone generator.

4. The ozone laundry system of claim 1, wherein the ozone generator is an electrolytic ozone generator.

5. The ozone laundry system of claim 1, further comprising a controller configured to control a flow rate of the water delivered to the wash drum from the first water supply line.

6. The ozone laundry system of claim 1, further comprising a valve configured to be in an open position or a closed position, wherein in the open position the valve allows the water to be delivered to the wash drum from the first water supply line and in the closed position the valve prevents the water from being delivered to the wash drum from the first water line.

7. The ozone laundry system of claim 6, wherein the ozone generator is configured to be in an on state introducing the ozone when the valve is configured in the open position and configured to be in an off state when the valve is configured in the closed position.

8. The ozone laundry system of claim 7, wherein the ozone generator is configured to switch between the on state and the off state based on a flow sensor coupled to the valve.

9. The ozone laundry system of claim 1, wherein the system is configured to maintain ozone levels in the wash drum at about 1 ppm throughout a wash cycle.

10. The ozone laundry system of claim 1, wherein the system is configured to maintain ozone levels in the wash drum at between about 0.5 ppm and about 2.0 ppm throughout a wash cycle.

11. The ozone laundry system of claim 1, further comprising a chemical chute attached to the wash drum, the chemical chute configured to receive the mixture of water, chemicals, and ozone from the chemical supply line prior to the entering the wash drum.

* * * * *